US005253699A

United States Patent [19]

Solignac et al.

[11] Patent Number: 5,253,699

[45] Date of Patent: Oct. 19, 1993

[54] PROCESS FOR IMPROVING THE SURFACE CONDITION AND THICKNESS REGULARITY OF A CAST METAL STRIP

[75] Inventors: Philippe Solignac, Saint Egrève; André Combry, Grenoble, both of, France

[73] Assignee: Pechiney Recherche, Courbevoie, France

[21] Appl. No.: 913,211

[22] Filed: Jul. 15, 1992

[30] Foreign Application Priority Data

Jul. 31, 1991 [FR] France ..... 91 09976

[51] Int. Cl.[5] ..... B22D 11/06

[52] U.S. Cl. ..... 164/463; 164/423; 164/415; 164/475

[58] Field of Search ..... 164/463, 423, 479, 429, 164/475, 415

[56] References Cited

U.S. PATENT DOCUMENTS 3,863,700 2/1975 Bedell et al. ..... 164/479

FOREIGN PATENT DOCUMENTS 467807 1/1992 European Pat. Off. ..... 164/479
470913 2/1992 European Pat. Off. .
58-159948 3/1982 Japan .
60-199552 10/1985 Japan .
62-93050 4/1987 Japan .
8702285 4/1987 World Int. Prop. O. .

*Primary Examiner*—Kuang Y. Lin
*Attorney, Agent, or Firm*—Dennison, Meserole, Pollack & Scheiner

[57] ABSTRACT

A process for improving the surface condition and thickness regularity of a thin metal strip cast on a rotating wheel by injection of a molten metal having a free surface forming a meniscus in contact with the wheel. The process comprises detecting undulations or variations in thickness of the strip of at least 10 μm, forming a gas cushion above the free surface utilizing a porous body disposed facing the free surface, and adjusting the pressure of the gas cushion, the location of the porous body or both to control the variations or undulations.

14 Claims, 2 Drawing Sheets

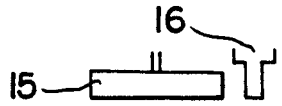
FIG. 2
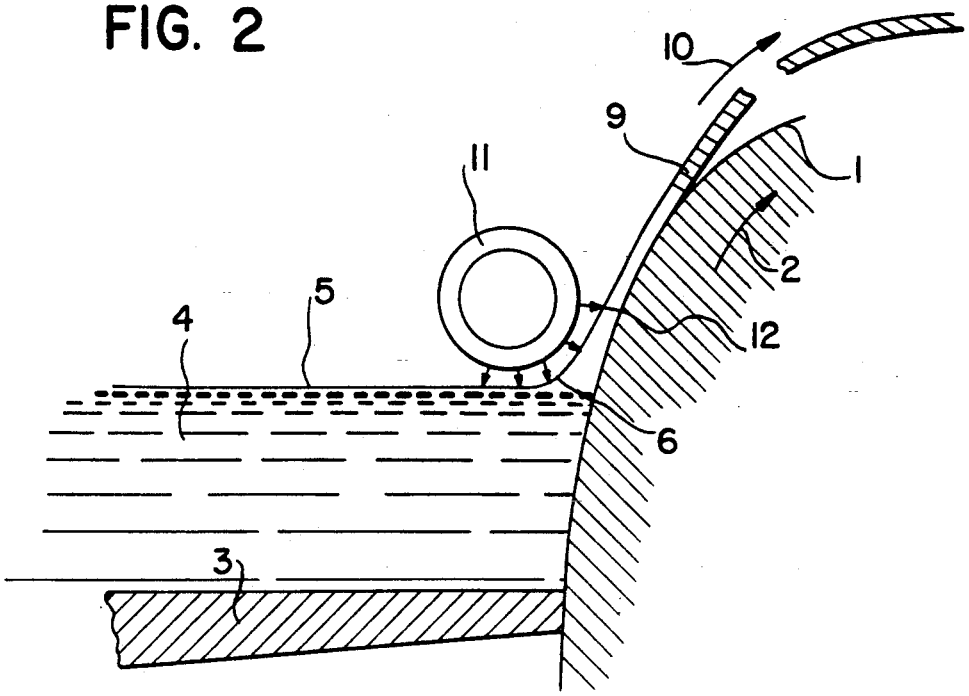
FIG. 3
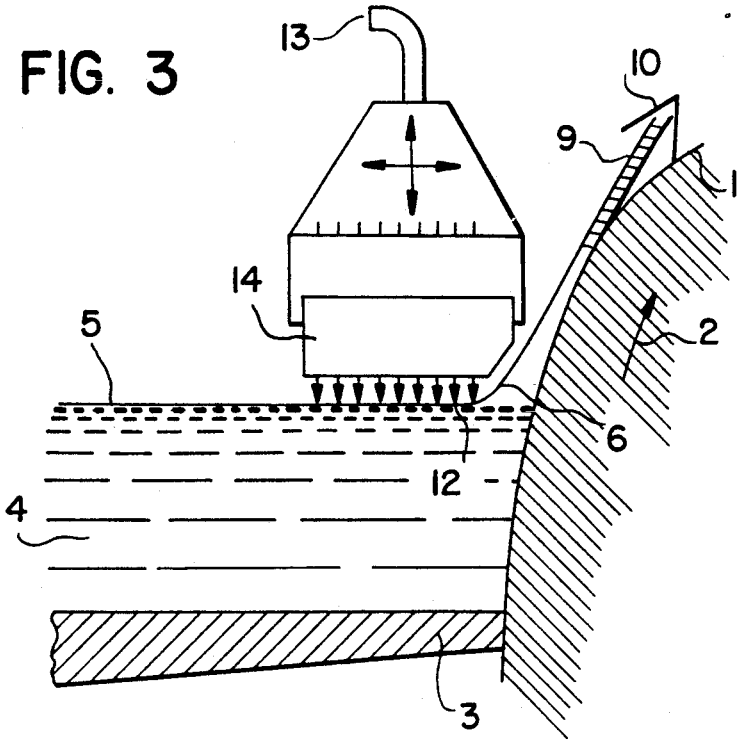

PROCESS FOR IMPROVING THE SURFACE CONDITION AND THICKNESS REGULARITY OF A CAST METAL STRIP

BACKGROUND OF THE INVENTION

1. Field of the Invention

The invention relates to the casting of metals in the molten state on a cooled rotary cylinder, wheel or roll in order to obtain a thin strip.

2. Description of Related Art

Those knowledgeable in the art of casting know that it is possible to directly and continuously obtain a solid strip with a thickness close to 1 mm by contacting metals in the molten state with the outer wall of a cooled, metal wheel, which rotates about a horizontal axis. This contacting is brought about by means of a liquid metal injector provided at its end with a U-shaped opening, which extends parallel to the generatrix of the wheel, in such a way that the free surface of the metal contained in the injector touches the surface of the wheel and on contact therewith forms a meniscus.

Under these conditions, the liquid metal solidifies on the cold wall of the wheel in the form of a product having a limited thickness and which, under the effect of the rotation, entrains by means of the meniscus a supplementary liquid quantity, so gnat a continuous metal strip is finally obtained. Such a process is, for example, described in French Patent 426,993.

PROBLEMS CAUSED

This melt overflow casting process, although simple in principle, suffers from certain difficulties with respect to its industrial application, when attempting to produce strips having a relatively large width, i.e. exceeding a few cm.

Usually, the wide strip produced in accordance with this process suffers from a poor appearance of the surface opposite to the wheel, an irregular thickness in the longitudinal and transverse directions and a transverse profile, where the thickness is greater on the edges than in the centre. These defects then make it difficult to use the strip either directly, or after it has undergone mechanical and/or thermal treatments, such as e.g. rolling.

Various solutions have already been proposed for obviating these defects.

Published European application No. 174765 teaches the use of barriers partly submerged in the molten material bath of the injector in order to obtain a uniform material flow over the entire width of the injector opening and consequently a regular strip thickness. However, this method suffers from the disadvantage of introducing foreign bodies into the bath, which can be a source of pollution with respect to the product produced and an obstacle to the regular travel of the material within the injector.

U.S. Pat. No. 4,771,819 uses a cooled, small diameter, rotary roll, which is partly immersed in the upper part of the molten material bath contained in the injector and whose distance from the casting wheel determines the thickness of the strip. However, this can lead to structural problems on the part of the strip obtained, particularly at the connection between the already solidified material portion and the liquid portion flowing beneath the roll. To this disadvantage can be added the appearance of tensions and stresses in the strip, particularly when there is a speed difference between the wheel and the roll. Finaally, the material layers deposited on the rotary surfaces meet in different directions, which can be prejudicial to the uniformity of the strip produced. Patent application WO 87/02285 proposes the continuous application of a gas jet to the surface of the liquid metal along the entire width of the strip. The description states that it is a thin jet directed along the intersection line of the metal surface and the casting surface, i.e. at the location where the strip emerges from the bath, the jet creating a depression on the surface of the metal and producing an undulation adjacent to the depression. Thus, quite apart from the fact that such a system requires large gas quantities, the gas jet can have a very prejudicial effect, because it creates eddies in the material mass within the injector and leads to the appearance of waves and, in the case where the material is a stainless metal, a dispersion of the oxide skins, which float on the surface of the bath. All these phenomena are prejudicial to the quality of the product produced.

SUMMARY OF THE INVENTION

The object of the present invention is thus, to obviate the various defects and to provide metal strips, particularly of aluminium or one of its alloys, which have a good surface appearance, i.e. a limited roughness on the two faces, a regular thickness over the entire length thereof and a transverse profile such that the thickness in the centre is at the most 2% greater than at the edges. These conditions must be fulfilled to provide good suitability for rolling.

Applicants have observed that the factors influencing the quality of strips are, in the case of the surface appearance, the macroscopic or microscopic movements of the free surface of the metal bath and, in the case of the thickness regularity, apart from the movements, the heat exchange conditions between the strip and the wheel (wheel temperature, molten metal temperature and regularity of the heat exchange coefficient).

It is therefore necessary to know the phenomena governing the free surface of the metal, both in its horizontal portion and at the meniscus, while establishing the extent to which they influence the stability thereof, so that their effects can be obviated. These phenomena are of at least three different types:

1. The first phenomenon relates to mechanical vibrations, the out-of-roundness of the casting wheel and an irregular supply to the injector of molten material. These problems can easily be observed and it is easily possible to find the means for obviating them.

2. The second phenomenon is the presence on the surface of the bath and in the vicinity of the meniscus of an oxide film, which is periodically entrained by the solid strip at a frequency variable between 50 and 200 Hz under normal casting conditions. This is accompanied by an undulation of the meniscus, which leads to thickness variations of the solid strip which can attain 20 to 100 μm.

3. The third phenomenon is that the thin layer of liquid metal moved out of the bath by the movement of the strip is destabilized under the effect of friction with air and the oxide layer and leads to the undulation of the meniscus with the same repercussions as described hereinbefore.

Unlike the first phenomenon, the second and third phenomena are difficult to detect with the naked eye as a result of their limited extent and high frequency. It is for this reason that up to now they have not been observed by users of machines for casting on a wheel or roll.

In discovering the effect of these phenomena on the strip, the Applicants have developed a process for improving the surface state and thickness regularity of a thin metal strip cast on a wheel by the stabilization of the free surface of the liquid metal placed in the injector and the surface of the meniscus in contact with the wheel. According to the process of the invention, strip is observed with means making it possible to detect undulations or variations in the thickness by an amount of at least 10 μm. Where such variations are detected, a gas cushion is formed above the surfaces with the aid of a detachable porous body positioned facing the surfaces and the gas pressure of the cushion and/or the position of the porous body relative to the surfaces is adjusted until the thickness variations or undulations disappear.

Thus, the invention includes a combination of three steps:

1. The first step involves consists of observing the surface of the strip not in contact with the wheel and preferably as close as possible to the location where it has formed. Observation takes place with the aid of a device for measuring thickness variations of the strip over its entire width, such devices being known, as well as a high-speed camera with stoppage on the image making it possible to detect surface undulations.

2. The second step involves of exerting on the meniscus and in the vicinity of the side of the injector a pressure of a gas which does not react with the metal so as to avoid any skin formation on the surface of the metal bath and the resulting repercussions on the formation of undulations. This pressure is not exerted directly from a random opening or from a jet, but is instead applied through a porous body. It has been found that such a body makes it possible to form a gas cushion ensuring a good distribution of the gas throughout the region of the meniscus without creating new undulations.

The porous body or material can be made from graphite or a ceramic foam and is shaped either like a tube extending parallel to the axis of the wheel with pores extending either over its entire periphery or only over that part facing the metal, or alternatively a cavity having faces adapted to the shape of the meniscus and the free surface of the bath, whereby only these faces are porous.

The tube and the cavity are connected to a gas source, such as argon or nitrogen, whose pressure can be regulated to a value at the most equal to 0.5 MPa and are mounted on a system making it possible to regulate their position relative to the horizontal surface of the bath and the wheel. This position is determined so as to preferably place the porous surface at a maximum of 10 mm from the metal surface and regulation must be possible with an accuracy of 1/10 mm.

3. The third step involves either an adjustment of the pressure of the gas supplying the porous body, this adjustment being obtained by a known means such as a pressure reducing valve and/or an adjustment of the position of the porous body with the aid of a system of regulation with respect to the liquid metal surfaces. These adjustments take place until the thickness variations or undulations revealed by the detection means disappear. Once established, these adjustments can be identified and applied in direct manner without any prior preparation in the case of new casting operations performed under identical conditions.

Moreover, by giving the porous body a variable porosity parallel to the axis of the wheel, it is possible to exert a variable pressure and give the strip a particular thickness profile. Thus, the profile can have a greater thickness in the centre of the strip, which makes it possible to obtain a more regular strip thickness after rolling.

The invention also has the advantage, due to the use of a gas which does not react with the metal, of protecting the metal against oxidation and thus preventing any formation of vibration-producing skins.

BRIEF DESCRIPTION OF THE DRAWINGS

The invention is described in greater detail hereinafter with reference to the attached drawings, wherein:

FIG. 2 is a vertical sectional view of a casting apparatus including a cylindrical porous body according to the invention;

FIG. 3 a vertical sectional view of a casting apparatus including a cavity-like porous body according to the invention.

DESCRIPTION OF THE PREFERRED EMBODIMENTS

Figure 1:
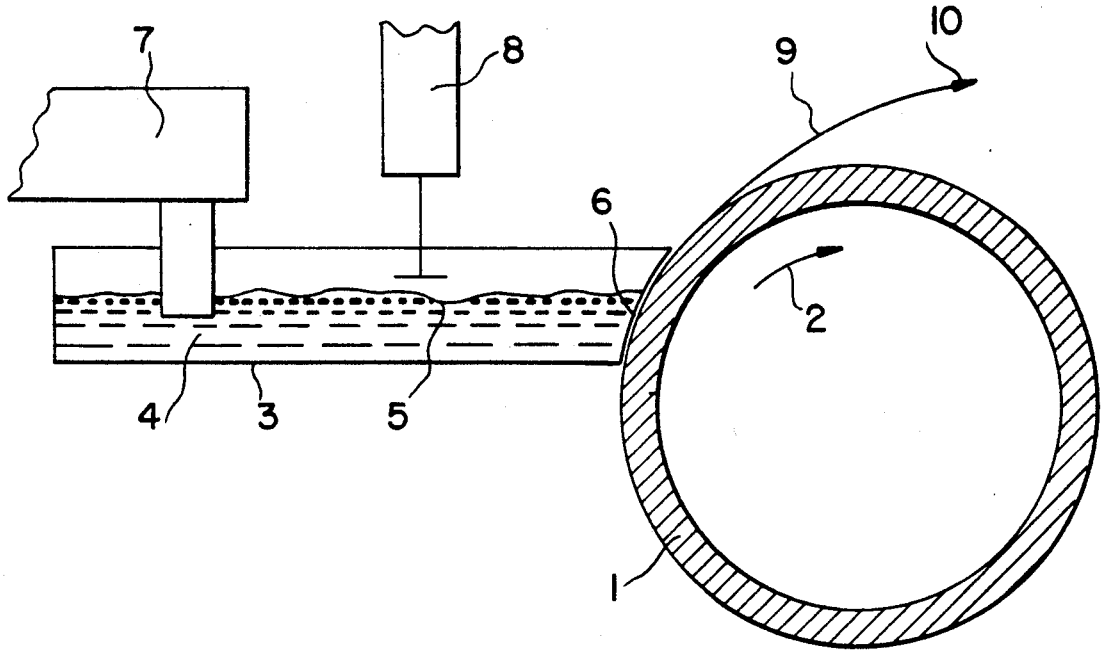
FIG. 1 PRIOR ART
FIG. 1 a diagrammatic view along a vertical section of a prior art apparatus casting on a wheel.

FIG. 1 shows a casting cylinder, wheel or roll 1 rotating in the direction of arrow 2 and internally cooled by a flow of water (not shown). An injector 3 supplied liquid or molten metal 4, whose free surface 5 forms, in contact with the wheel 1, a meniscus 6. The injector is provided with a spout or channel 7 and a level sensor 8. Under the effect of the rotation of the wheel and the cooling, the liquid metal contained in the injector and in contact with the wheel is entrained and forms a continuous strip 9, which moves in the direction of the arrow 10.

FIG. 2 shows the casting apparatus of FIG. 1, to which has been added according to the invention a cylindrical porous body or material 11, which produces the gas cushion represented by the arrows 12. Thickness variations in the strip are determined by a device 15 as is known in the art, and surface undulations are recorded by a high speed camera 16.

FIG. 3 shows a casting apparatus similar to FIG. 2, but with a variation in the porous body, which is shaped like a cavity supplied by a pipe 13 and with a porous block 14, which distributes the gas in the direction of the arrows 12 by facing the meniscus and part of the free surface of the metal bath.

EXAMPLE

The invention can be illustrated with the aid of the following example, in which an aluminium alloy of type 3003 in accordance with the Aluminium Association standards is cast onto a 350 mm radius steel wheel. The wheel rotates at 1.5 m/s, the liquid metal height in the injector is 40 mm and the liquid metal temperature is 700° C.

The result is 300 mm wide and 0.75 mm thick strip, having a surface opposite to that of the wheel with undulations of on average 30 μm. The casting machine is equipped with a ceramic foam tube with an external diameter of 30 mm and average pore size of 1 mm, placed 5 mm from the wheel and 5 mm from the surface of the bath, and supplied with nitrogen under a pressure of 0.1 MPa. By operation of the foam tube, the strip has undulations of on average less than 10 μm.

The invention can be used for obtaining by casting on a wheel, sheets of regular thickness with a good surface appearance and a profile suitable for rolling.

I claim:

1. Process for improving the surface condition and thickness regularity of a thin metal strip of known width cast on a rotating wheel by injection of molten metal having free surface forming a meniscus in contact with the wheel, comprising:

detecting undulations or variations in thickness of the strip of at least 10 μm, forming a gas cushion above the free surface by means of a porous body disposed facing the free surface, and adjusting pressure of the gas cushion, the location of the porous body, or both the pressure and location to control the variations or undulations.

2. Process according to claim 1, wherein the porous body is placed at most 10 mm from the free surface of the molten metal.

3. Process according to claim 1, wherein the porous body is supplied with a gas under a pressure of at most 0.5 MPa.

4. Process according to claim 1, wherein the gas cushion is formed from a gas which does not react with the molten metal.

5. Process according to claim 4, wherein the gas is nitrogen or argon.

6. Process according to claim 1, wherein said porous body comprises graphite or ceramic foam.

7. Process according to claim 1, wherein the porous body has pores of average size about 1 mm.

8. Process according to claim 1, wherein the porous body is in the form of a tube extending parallel to the axis of rotation of the wheel.

9. Process according to claim 1, wherein the porous body comprises one face of a chamber connected to a source of gas.

10. Process according to claim 1, wherein the wheel is cooled.

11. Process according to claim 1, additionally comprising varying gas pressure along the width of the strip in order to vary metal thickness along the width of the strip.

12. Process according to claim 1, wherein said porous body is removable.

13. In a process for casting a thin strip of metal on a rotating wheel from an injector containing liquid metal having a free surface forming a meniscus in contact with the wheel, the improvement comprising determining undulations or variations in thickness of the strip in an amount of at least 10 μm, forming a gas cushion above said free surface by means of a porous body disposed facing said surface, and adjusting gas pressure of said cushion, location of the porous body or both gas pressure and location to control the undulations or variations in thickness.

14. Apparatus for casting a thin strip of metal comprising:

a wheel in combination with a means for rotation thereof;

an injector for injecting molten metal onto said wheel the molten metal having a free surface forming a meniscus in contact with said wheel;

means for determining undulations or variations in thickness of the strip of at least 10 μm;

a porous body disposed facing the free surface and connected to a source of gas for producing a gas cushion above the free surface, and means for adjusting the gas cushion comprising means for adjusting gas pressure, means for adjusting the position of the porous body, or both means for adjusting pressure and position.

* * * * *

UNITED STATES PATENT AND TRADEMARK OFFICE

CERTIFICATE OF CORRECTION

PATENT NO. : 5,253,699

DATED : October 19, 1993

INVENTOR(S) : Philippe Solignac et al

It is certified that error appears in the above-identified patent and that said Letters Patent is hereby corrected as shown below:

Item [73],

Title page, following "Assignee:", change

"PECHINEY RECHERCHE" to --PECHINEY RHENALU--.

Signed and Sealed this

Ninth Day of August, 1994

*Attest:*

*Attesting Officer*

BRUCE LEHMAN

*Commissioner of Patents and Trademarks*